US012018598B2

(12) United States Patent
Tian

(10) Patent No.: US 12,018,598 B2
(45) Date of Patent: Jun. 25, 2024

(54) ENGINE VALVE SYSTEM HAVING ROCKER ARM ASSEMBLY WITH ROLLER LOCK FOR SELECTIVE ENGINE VALVE DEACTIVATION

(71) Applicant: Caterpillar Inc., Peoria, IL (US)

(72) Inventor: Ye Tian, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 343 days.

(21) Appl. No.: 17/035,256

(22) Filed: Sep. 28, 2020

(65) Prior Publication Data

US 2022/0099004 A1 Mar. 31, 2022

(51) Int. Cl.

| | |
|---|---|
| ***F01L 1/18*** | (2006.01) |
| ***F01L 1/26*** | (2006.01) |
| ***F01L 1/46*** | (2006.01) |
| ***F01L 13/00*** | (2006.01) |
| ***F01L 13/06*** | (2006.01) |

(52) U.S. Cl.

CPC ..... *F01L 1/181* (2013.01); *F01L 1/26* (2013.01); *F01L 1/46* (2013.01); *F01L 13/0005* (2013.01); *F01L 13/06* (2013.01); *F01L 2305/00* (2020.05)

(58) Field of Classification Search

CPC ..... F01L 1/181; F01L 1/46; F01L 2305/00; F01L 2013/001; F01L 13/0005; F01L 13/06; F01L 1/2411; F01L 13/065

USPC ..... 123/90.16, 90.46, 90.36, 90.39

See application file for complete search history.

(56) References Cited

U.S. PATENT DOCUMENTS

| | | | | |
|---|---|---|---|---|
| 4,917,056 | A * | 4/1990 | Yagi | F01L 1/181 123/90.11 |
| 5,584,268 | A * | 12/1996 | Natkin | F01L 13/0005 123/90.46 |
| 6,644,271 | B1 | 11/2003 | Cotton, III | |
| 8,109,245 | B2 | 2/2012 | Tateno | |
| 9,181,821 | B2 | 11/2015 | Meldolesi et al. | |
| 10,436,079 | B2 | 10/2019 | Pham | |
| 2001/0050066 | A1 * | 12/2001 | Sugiyama | F02D 13/0265 123/90.15 |
| 2017/0356372 | A1 * | 12/2017 | Richards | F02B 37/12 |
| 2019/0063268 | A1 | 2/2019 | Buonocore et al. | |

FOREIGN PATENT DOCUMENTS

| | | | | |
|---|---|---|---|---|
| WO | WO-0206642 | A1 * | 1/2002 | F01L 1/34 |
| WO | WO-03067067 | A1 * | 8/2003 | F01L 1/18 |
| WO | WO-2019117825 | A1 * | 6/2019 | F01L 1/047 |

OTHER PUBLICATIONS

WO-0206642-A1, English Language Machine Translation (Year: 2002).*

* cited by examiner

*Primary Examiner* — Wesley G Harris

(74) *Attorney, Agent, or Firm* — Brannon Sowers & Cracraft PC

(57) ABSTRACT

A rocker arm assembly for an engine valve system includes a rocker arm for actuating an engine valve, a stop, a biaser, and a swing lock attached to one of the valve end or the cam end of the rocker arm and defining a pivot axis, and including an actuating surface. The actuating surface is rotatable between a stopped orientation and an idled orientation, and the biaser biases the swing lock towards the stopped orientation where the swing lock contacts the stop and traps the swing lock between the rocker arm and one of an engine valve or a cam. The swing lock is movable in (Continued)

opposition to a bias of the biaser toward the idled orientation to deactivate the engine valve.

19 Claims, 4 Drawing Sheets

ENGINE VALVE SYSTEM HAVING ROCKER ARM ASSEMBLY WITH ROLLER LOCK FOR SELECTIVE ENGINE VALVE DEACTIVATION

TECHNICAL FIELD

The present disclosure relates generally to a rocker arm assembly for an engine valve system, and more particularly to a swing lock in a rocker arm assembly rotatable between a stopped orientation where an associated engine valve is activated, and an idled orientation where the engine valve is deactivated.

BACKGROUND

A wide variety of valve actuation systems are known from the internal combustion engine field. In one common design, a camshaft is rotated by way of a cam gear in the engine gear train. Rotation of the cam causes cam lobes having non-circular shapes upon the cam to rotate in contact with components that open and close the engine valves, such as exhaust valves and intake valves. Some designs employ a valve lifter including a pushrod that extends between the camshaft and rocker arms supported for reciprocation in or upon the engine head. Other designs position the camshaft such that the cam lobes directly contact the rocker arms. The rocker arms reciprocate to push open engine valves, typically in opposition to valve return springs.

In some instances it can be desirable to deactivate engine valves. Deactivating engine valves has been widely employed for so-called engine braking for many years. In a general example, the engine valves are closed to cause pistons reciprocating in the engine to compress fluids in the combustion cylinders instead of expelling those fluids from the cylinders. The additional work required by the individual deactivated cylinders increases resistance to rotation of the engine crankshaft in a manner that reduces or otherwise controls engine speed.

Existing engine braking systems can be relatively complex and expensive, requiring multiple moving parts within the engine valve train that can decouple mechanical connections amongst the parts when desired, and then reestablish such mechanical connections as needed. U.S. Pat. No. 6,644,271 to Cotton is directed to an engine braking system for a multi-cylinder engine. In the Cotton disclosure, valve actuators are apparently configured to alternatively fluidly couple to a supply of low pressure fluid or an engine fluid sump. A braking control valve is operably coupled to some of the valve actuators and movable between a first position at which the valve actuators are coupled to the sump and blocked from the low pressure fluid, and a second position at which the valve actuators are coupled to the low pressure fluid and blocked from the sump. While Cotton may have various applications there is always room for improvement and development of alternative strategies in this field.

SUMMARY OF THE INVENTION

In one aspect, a rocker arm assembly for an engine valve system includes a rocker arm for actuating an engine valve, and including a valve end, a cam end, and a shaft bore defining a bore center axis and formed between the valve end and the cam end to receive a rocker shaft supporting the rocker arm for reciprocation. The rocker arm assembly further includes a stop, and a swing lock attached to one of the valve end or the cam end of the rocker arm, and including a holder defining a pivot axis oriented parallel to the bore center axis, and an actuating surface. The rocker arm assembly further includes a biaser. The actuating surface is supported by the holder at a location spaced from the pivot axis and rotatable with the holder between a stopped orientation about the pivot axis and an idled orientation about the pivot axis. The biaser biases the swing lock toward the stopped orientation, such that the swing lock is in contact with the stop to trap the swing lock between the rocker arm and one of an engine valve or a cam, and the swing lock is movable in opposition to a bias of the biaser toward the idled orientation.

In another aspect, an engine valve system includes a cam rotatable about a cam axis, an engine valve, and a rocker arm including a valve end, a cam end, and a shaft bore formed between the valve end and the cam end. A rocker shaft is positioned in the shaft bore and supports the rocker arm for reciprocating movement in response to rotation of the cam. The engine valve system further includes a swing lock defining a pivot axis and including an actuating surface. The swing lock is rotatable about the pivot axis relative to the rocker arm between a stopped orientation and an idled orientation. The swing lock is trapped between the rocker arm and one of the engine valve or the cam, at the stopped orientation, such that the actuating surface transmits movement of reciprocation between the rocker arm and the respective one of the engine valve or the cam, and the engine valve is activated. The swing lock is not trapped between the rocker arm and the respective one of the engine valve or the cam at the idled orientation, such that the actuating surface does not transmit the movement of reciprocation, and the engine valve is deactivated.

In still another aspect, a method of operating an engine valve system includes reciprocating a rocker arm based on rotation of a cam in the engine valve system, and opening and closing an engine valve in the engine valve system based on the reciprocation of the rocker arm. The method further includes rotating a swing lock about a pivot axis from a stopped orientation where an actuating surface in the swing lock transmits movement of reciprocation between the rocker arm and one of the engine valve or the cam, to an idled orientation. The method further includes deactivating the engine valve based on the rotating of the swing lock to the idled orientation.

DETAILED DESCRIPTION

Figure 1:
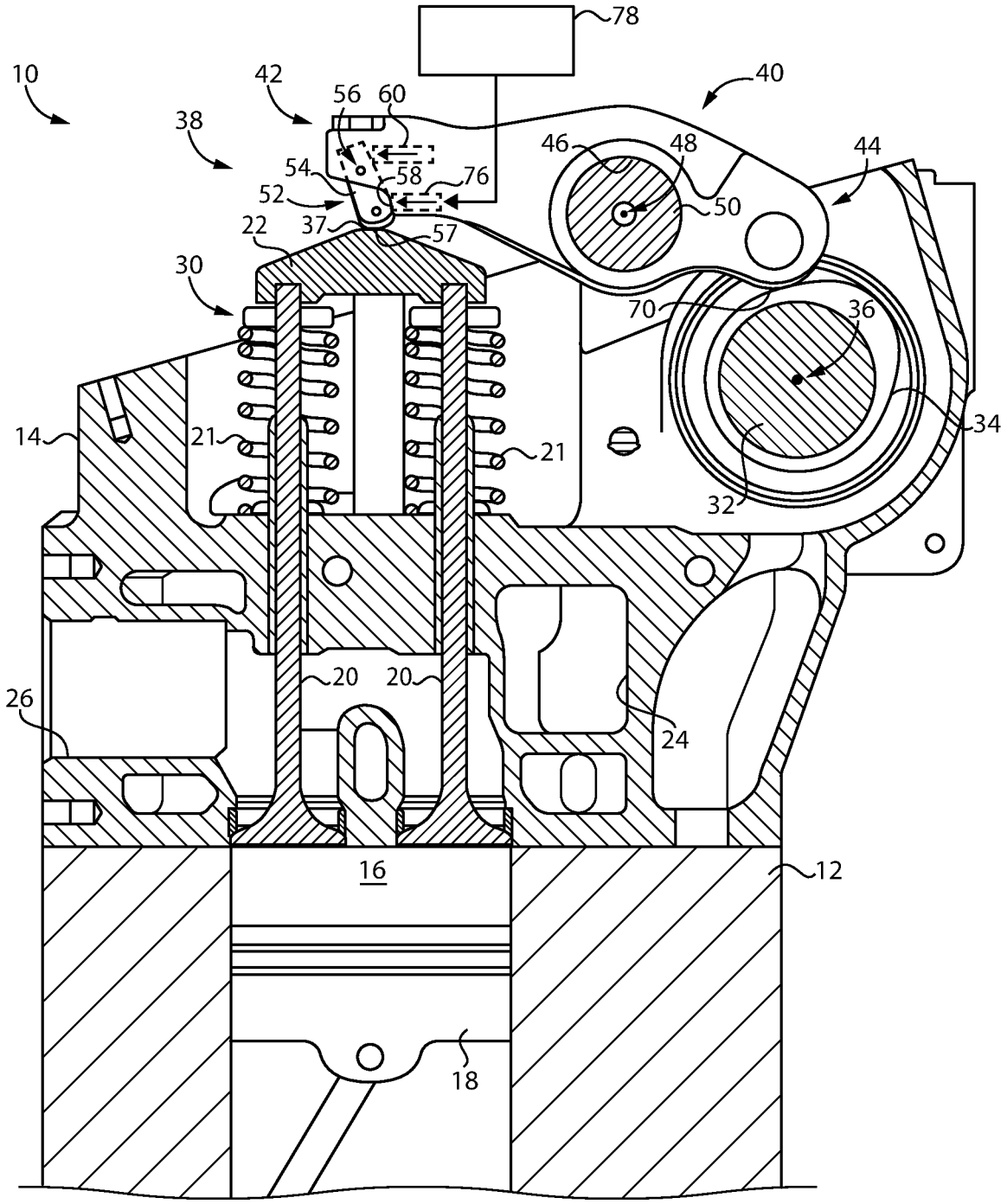
FIG. 1 is a sectioned side diagrammatic view of an engine system including an engine valve system, according to one embodiment.

Referring to FIG. 1, there is shown an internal combustion engine system 10 according to one embodiment, and including a cylinder block 12 having a combustion cylinder 16 formed therein. A piston 18 is movable in cylinder 16 between a bottom dead center position and a top dead center position, typically in a four-stroke engine cycle. An engine head 14 is coupled to cylinder block 12 and has an intake conduit 24 and an exhaust conduit 26 formed therein to convey air, or potentially air mixed with fuel and/or exhaust, into cylinder 16, and to convey exhaust out of cylinder 16, respectively. A plurality of engine valves 20 are shown supported in engine head 14, and may include exhaust valves, or intake valves for controlling fluid communications between cylinder 16 and one of intake conduit 24 or exhaust conduit 26. In the illustrated embodiment engine valves 20 include exhaust valves coupled together with a valve bridge 22 and structured to open, in opposition to a biasing force of return springs 21, to enable piston 18 to expel combustion exhaust to exhaust conduit 26. When engine valves 20 are closed, and one or more intake valves also closed, piston 18 can compress fluids in cylinder 16 to an autoignition threshold as is well known in the art. As will be further apparent from the following description, one practical application of the present disclosure is contemplated to be engine braking where engine valves 20 are maintained closed, at times, to require piston 18 to compress fluids in cylinder 16 in an engine cycle without combustion to slow a speed of engine system 10 based on the work required to compress the fluids in cylinder 16 according to well known principals.

Engine system 10 further includes an engine valve system 30 of which engine valves 20 are a part. Valve system 30 also includes a camshaft 32 including one or more cams 34, and being rotatable about a cam axis 36. Engine valve system 30 further includes a rocker arm assembly 38 including a rocker arm 40 for actuating one or more engine valves, including engine valves 20 in the illustrated embodiment. Rocker arm assembly 38 may be one of a plurality of rocker arm assemblies similarly constructed, and each associated with one or more engine valves for a cylinder in engine system 10. Rocker arm 40 includes a valve end 42, a cam end 44, and a shaft bore 46 defining a bore center axis 48. Shaft bore 46 is formed between valve end 42 and cam end 44 and receives a rocker shaft positioned in shaft bore 46 and supporting rocker arm 40 for reciprocation in response to rotation of cam 34. In the illustrated embodiment rocker arm assembly 38 includes a cam follower 70 that rotates in contact with cam 34, cam 34 having a non-cylindrical shape for inducing the reciprocating movement of rocker arm 40 according to well-known principles. As noted above rocker arm assembly 38 may be one of a plurality of rocker arm assemblies, with each cylinder 16 in engine system 10 being associated with an intake valve rocker arm, an exhaust valve rocker arm, and potentially a fuel injector rocker arm. Engine system 10 may include a compression-ignition engine as suggested above, however, the present disclosure is not thereby limited and spark-ignited engines or prechamber ignited engines fall within the scope of the present disclosure. Engine system 10 can include any number of combustion cylinders in any suitable arrangement.

Figure 2:
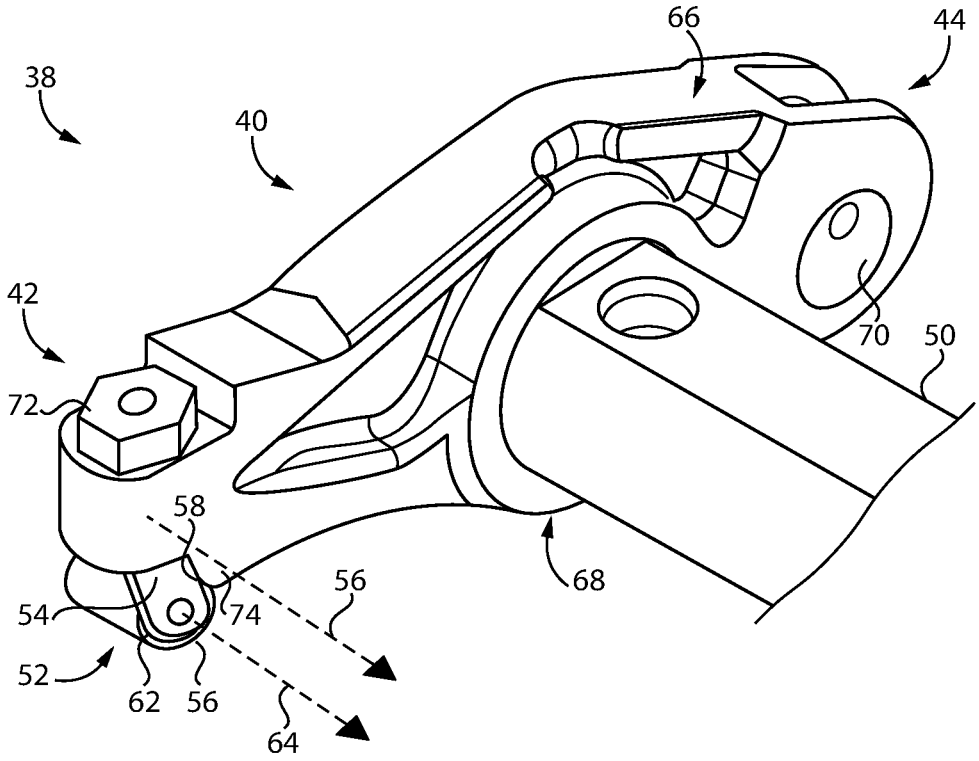
FIG. 2 is a perspective view of a rocker arm assembly, according to one embodiment.

Referring also now to FIG. 2, rocker arm 40 includes a rocker arm upper surface 66 and a rocker arm lower surface 68, each extending between valve end 42 and cam end 44. A swing lock 52 is attached to one of valve end 42 or cam end 44, and in the illustrated embodiment of FIG. 1 and FIG. 2 is attached to valve end 42. A lash adjustment mechanism 72 may be coupled to valve end 52 in some embodiments. Swing lock 52 includes a roller holder or holder 54 supported in rocker arm 40 and defining a pivot axis 56 oriented parallel to bore center axis 48. Pivot axis 56 extends through rocker arm 40 in the illustrated embodiment. Swing lock 52 further includes an actuating surface 57. Actuating surface 57 can include an arcuate surface and is shaped and located so as to contact an upper surface 37 of valve bridge 22, or to contact an intervening surface interposed valve bridge 22 and rocker arm 40. Actuating surface 57 could also be shaped and positioned to contact a tappet, a valve stem, or another structure of, or associated with, one or more engine valves. Actuating surface 57 is supported by holder 54 at a location spaced from pivot axis 56. Swing lock 52, and including both actuating surface 57 and holder 54, is rotatable between a stopped orientation about pivot axis 56, as shown in FIG. 1 and FIG. 2, and an idled orientation about pivot axis 56. At the stopped orientation swing lock 52 contacts a stop 58, and swing lock 52 is trapped between rocker arm 40 and one of an engine valve 20 or cam 34. In the illustrated embodiment at the stopped orientation swing lock 52 is trapped between rocker arm 40 and both of engine valves 20. Trapped between does not require that swing lock 52 physically contact engine valves, merely that swing lock 52 is held in place among the interconnecting components of engine valve system 30 such that actuating surface 57 transmits movement of reciprocation between rocker arm 40 and the respective one of engine valve(s) 20 or cam 34. In the configuration shown, engine valves 20 are activated. As further discussed herein, at the idled orientation swing lock 52 is not trapped between rocker arm 40 and the respective one of engine valves 20 or cam 34, such that actuating surface 57 does not transmit the movement of reciprocation, and engine valves 20 are deactivated.

Also in the illustrated embodiment, holder 54 includes a fork, and swing lock 52 includes a roller 62 defining a roller axis 64 and having actuating surface 57 formed thereon. Rocker arm assembly 38 further includes a biaser 60 biasing swing lock 52 toward the stopped orientation. Swing lock 52 is thus movable in opposition to a bias or biasing force of biaser 60 toward the idled orientation. Biaser 60 may include a biasing spring resident in rocker arm 40. Rocker arm assembly 38 further includes a fluid actuator 76 structured to rotate swing lock 52 about pivot axis 56 from the stopped orientation toward the idled orientation in opposition to the biasing force produced by biaser 60. When actuator 76 is reversed or deactivated biaser 60 can urge swing lock 52 back to the stopped orientation.

Figure 3:
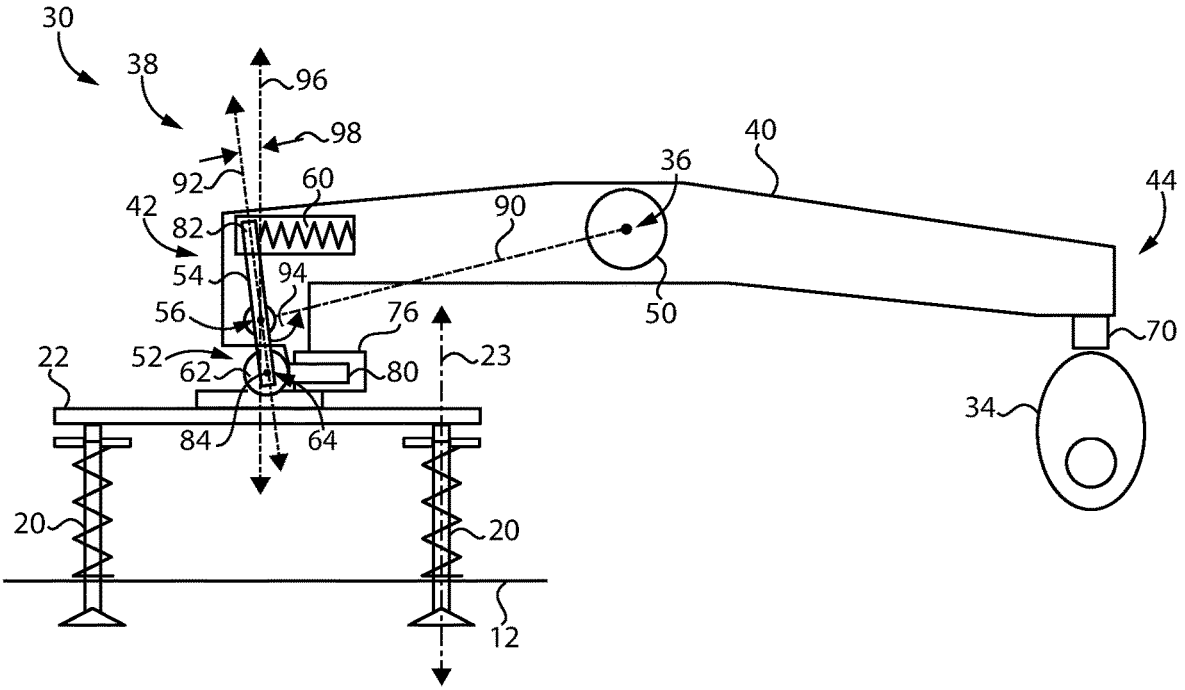
FIG. 3 is a diagrammatic view of an engine valve system in an activated configuration, according to one embodiment.

Referring also now to FIG. 3, there is illustrated diagrammatically engine valve system 30 and rocker arm assembly 38 with additional functional and structural features shown. Holder 54 may include a pivot end 82, typically positioned within rocker arm 40, and a roller end 84. Biaser 60 may be operably coupled to pivot end 82 of holder 54. A pivot path defined by roller axis 64 between the stopped orientation and the idled orientation extends between rocker arm 40 and engine valves 20, or in other embodiments between a rocker arm and a cam. It can also be seen from FIG. 3 that actuator 76 is coupled with roller end 84. Actuator 76 can contact holder 54, or can contact roller 62. Actuator 76 includes an actuator pin 80, and thus actuator 76 may include a fluid actuated pin actuator in some embodiments and as further discussed herein. In FIG. 1 a hydraulic actuation system 78 is shown coupled with actuator 76 for such purposes.

As also shown in FIG. 3, a fixed plane 90 is defined by bore center axis 36 and pivot axis 56 and contains each of bore center axis 36 and pivot axis 56. A moving plane 92 is defined by roller axis 64 and pivot axis 56 and contains each of roller axis 64 and pivot axis 56. Also illustrated in FIG. 3 is a valve axis of reciprocation 23, and a vertical plane 96.

During operation, rocker arm 40 reciprocates generally up and down with vertical plane 96 remaining generally oriented parallel to valve axis of reciprocation 23. Moving plane 92 will vary in its orientation relative to fixed plane 90, and relative also to vertical plane 96 and valve axis of reciprocation 23. In FIG. 3 moving plane 92 extends upwardly and outwardly above rocker arm 40, and swing lock 52 is inclined downward, and inward in a direction generally toward a middle of rocker arm 40. A closing bias of valve return springs 21 in cooperation with biaser 60 will tend to cause roller 62 to remain held fast against stop 58. As depicted in FIG. 2 stop 58 may be formed by a downward protrusion 74 of rocker arm 40, such that stop 58 forms a part of rocker arm lower surface 68, and roller 62 and actuating surface 57 are in contact with rocker arm lower surface 68 at the stopped orientation. At the stopped orientation as depicted in FIG. 3, an angle 98 is formed between vertical plane 96 and moving plane 92. Another angle 94 is formed between and defined by moving plane 92 and fixed plane 90. At the stopped orientation angle 94 is an acute included angle between plane 90 and plane 92. Angle 98 is also an acute angle, opening upward relative to rocker arm 40, and may be in a range of 1° to 5°, more particularly 1° to 3° in some embodiments.

Figure 4:
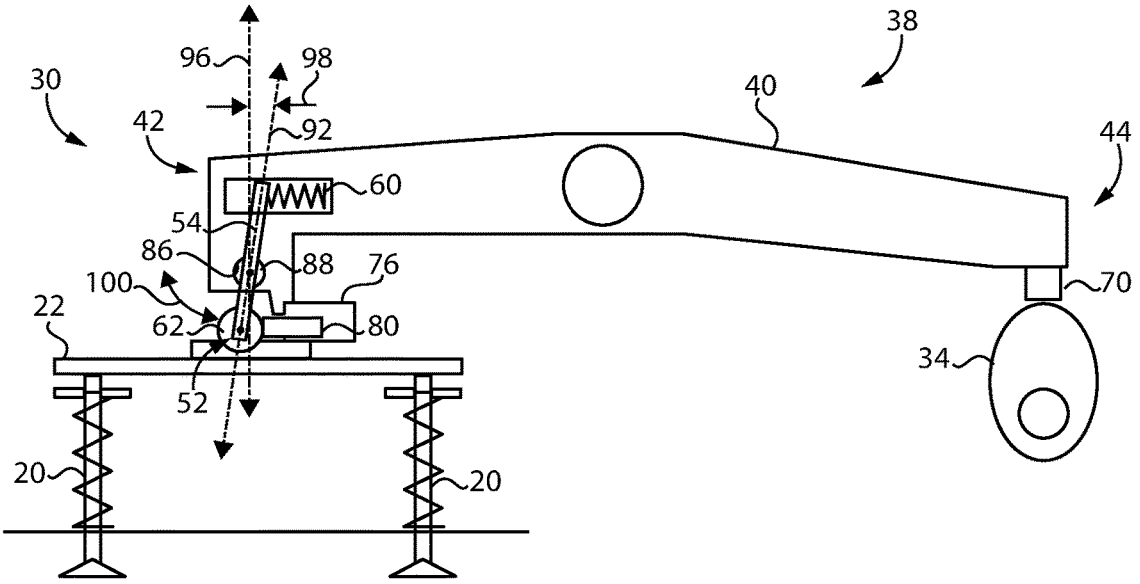
FIG. 4 is a diagrammatic view of an engine valve system in a deactivated configuration, according to one embodiment.

Referring now also to FIG. 4, there is shown engine valve system 30 and rocker arm assembly 38 as they might appear where swing lock 52 has been adjusted to the idled orientation. Actuator 76 can be operated to push pin 80, contacting holder 54 or roller 62, for example, such that moving plane 92 is rotated relative to rocker arm 40 from the orientation shown in FIG. 2. Angle 98 may be an acute angle at the idled orientation, opposite in sign relative to the stopped orientation, and roller 62 is now advanced away from stop 58 and no longer trapped between rocker arm 40 and engine valves 20. Swing lock 52 as depicted in FIG. 4 does not transmit movement of reciprocation between rocker arm 40 and engine valves 20. Instead rocker arm 40 continues to reciprocate based on rotation of cam 34, but swing lock 52 will reciprocate idly or passively among a plurality of idled orientations in an angular range 100 with engine valves 20 remaining closed. Also shown is a pivot pin bore 86 formed in valve end 42 of rocker arm 40. A pivot pin 88 of swing lock 52 is within pivot pin bore 86 and attached to holder 54, defining pivot axis 56. It will be recalled that biaser 60 may be resident in rocker arm 40, and actuator 76 may be resident in or separately attached to rocker arm 40. In an alternative configuration the locations of biaser 60 and actuator 76 might be swapped relative to that which is illustrated. Either or both of biaser 60 and actuator 76 can be located within rocker arm 40 or attached outside of rocker arm 40.

Figure 5:
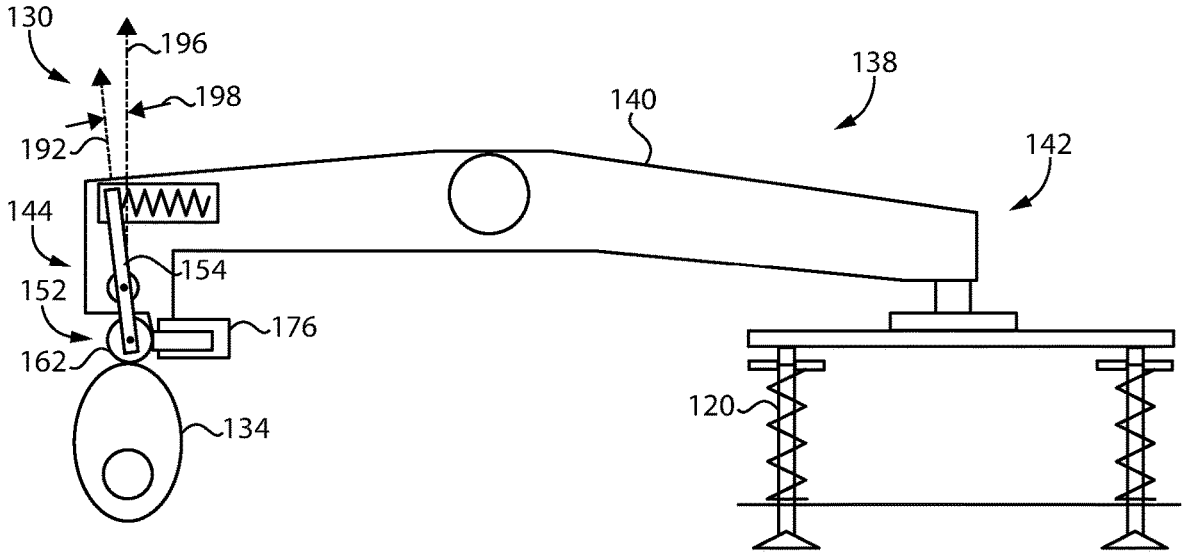
FIG. 5 is a diagrammatic view of an engine valve system in an activated configuration, according to another embodiment.

Referring now to FIG. 5, there is shown an engine valve system 130 including a rocker arm assembly 138 according to another embodiment. Rocker arm assembly 138 includes a rocker arm 140 having a valve end 142 and a cam end 144. Rocker arm 140 may be structured similarly to the aforementioned embodiments, but instead of a swing lock attached to a valve end, a swing lock 152 is attached to cam end 144 of rocker arm 140. Swing lock 152 includes a holder 154 supporting a roller 162 in a manner generally analogous to that of holder 52 discussed above. A biaser 160 biases swing lock 152 toward a stopped orientation, as shown in FIG. 5, and an actuator 176 is provided to rotate swing lock 152 in opposition to a biasing force produced by biaser 160 toward an idled orientation. At the stopped orientation, swing lock 152 is trapped between rocker arm 140 and a cam 134 such that motion of reciprocation is transmitted between rocker arm 140 and cam 134. Thus, when swing lock 152 is at the stopped orientation rotation of cam 134 causes rocker arm 140 to reciprocate to open and close an engine valve 120. A vertical plane defined similarly to that of the embodiments described above is shown at 196. A moving plane defined analogously as in the embodiments described above is shown at 192. An angle 198 is defined by plane 196 and plane 192. Actuator 176 can be operated to rotate swing lock 152 to the idled orientation such that rocker arm 140 will cease to reciprocate in response to rotation of cam 134 and engine valve 120 will be deactivated. Actuator 176 may be operated in a reverse direction, or deactivated to enable biaser 160 to urge swing lock 152 from the idled orientation back to the stopped orientation, as is the case in rocker arm assembly 38. Features and functionality of rocker arm assembly 138 not specifically described can be understood to be analogous to features and functionality of the other embodiments described herein.

Figure 6:
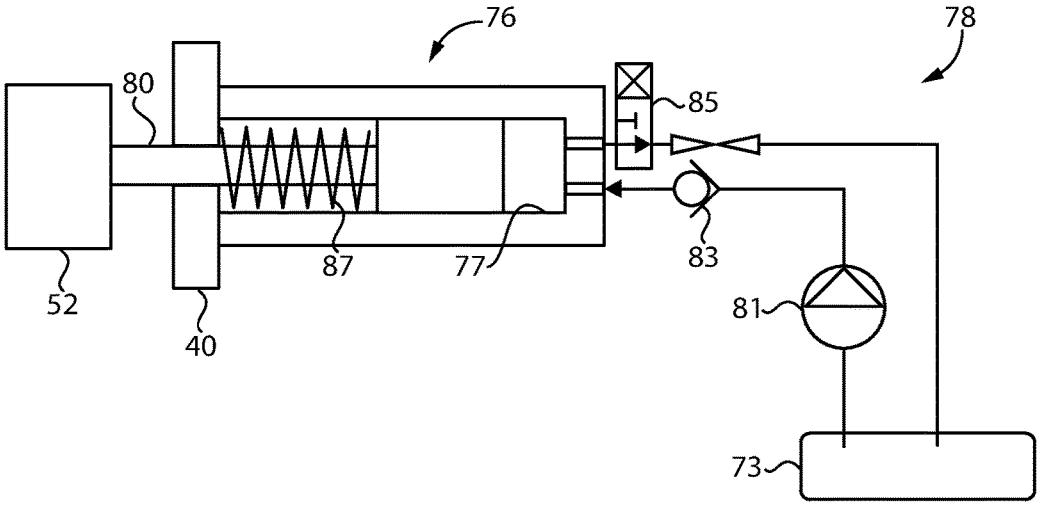
FIG. 6 is a diagrammatic view of an actuating system for a rocker arm assembly in an engine valve system, according to one embodiment.

Referring now to FIG. 6, there is shown actuation system 78 illustrating further details. Pin 80 is shown in contact with swing lock 52, and supported in rocker arm 40. A fluid cavity is shown at 77, and receives a flow of fluid from a hydraulic tank 73 by way of a pump 81 and a check valve 83. A solenoid-operated shutoff valve is shown at 85, which may be normally open. During normal operation, pump 81 can pump hydraulic fluid into cavity 77, which fluid is returned through solenoid valve 85 to tank 73. When it is desirable to adjust swing lock 52 from the stopped orientation to the idled orientation to deactivate an engine valve, shutoff valve 85 can be actuated to block fluid flow out of cavity 77 and enable pressure to build which drives pin 80 linearly to adjust swing lock 52 as described herein. When it is desirable to return swing lock 52 to the stopped orientation to reactivate an engine valve, shutoff valve 85 can be opened, and pin 80 will move linearly, such as with the assistance of a return spring 87, and permit swing lock 52 to be returned to the stopped orientation.

INDUSTRIAL APPLICABILITY

Referring to the drawings generally, but in particular to the embodiment of FIGS. 1-4, operating engine valve system 30 can include reciprocating rocker arm 40 based on rotation of cam 34 in engine valve system 30. One or more engine valves 20 can be opened and closed in engine valve system 30 based on the reciprocation of rocker arm 40. This will generally be the case when swing lock 52 is in the stopped orientation, transmitting movement of reciprocation between rocker arm 40 and engine valves 20. In the case of the embodiment of FIG. 5, in the stopped orientation actuating surface of roller 162 will transmit movement of reciprocation between rocker arm 140 and cam 134, causing rocker arm 140 to reciprocate. To deactivate engine valves 20 swing lock 52 is rotated about pivot axis 57 from the stopped orientation to the idled orientation as discussed herein. With swing lock 52 idled rocker arm 40 can continue to reciprocate but will not transmit movement of reciprocation to engine valves 20. In the case of the embodiment of FIG. 5 rocker arm 140 will not reciprocate in response to the rotation of cam 134. In either case associated engine valves remain closed, permitting an engine system and in particular an associated cylinder in the engine system to be braked based on the deactivating of the subject engine valves.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A rocker arm assembly for an engine valve system comprising:

a rocker arm for actuating an engine valve and including a valve end, a cam end, and a shaft bore defining a bore center axis and formed between the valve end and the cam end to receive a rocker shaft supporting the rocker arm for reciprocation;

a stop;

a swing lock attached to one of the valve end or the cam end of the rocker arm, and including a holder defining a pivot axis oriented parallel to the bore center axis, and the holder further including a fork supporting a roller defining a roller axis and having an actuating surface;

a biaser;

the actuating surface is supported by the holder at a location spaced from the pivot axis and rotatable with the holder between a stopped orientation about the pivot axis and an idled orientation about the pivot axis; and the biaser biases the swing lock toward the stopped orientation, and the swing lock is held in contact with the stop via a biasing force of the biaser to trap the swing lock between the rocker arm and one of the engine valve or a cam, and the swing lock is movable in opposition to the biasing force of the biaser toward the idled orientation.

2. The rocker arm assembly of claim 1 wherein:

a fixed plane is defined by the bore center axis and the pivot axis and contains each of the bore center axis and the pivot axis;

a moving plane is defined by the roller axis and the pivot axis and contains each of the roller axis and the pivot axis; and the fixed plane and the moving plane define an acute included angle at the stopped orientation of the swing lock.

3. The rocker arm assembly of claim 1 wherein the holder includes a pivot end and a roller end, and the biaser is operably coupled to the pivot end of the holder.

4. The rocker arm assembly of claim 3 wherein the biaser includes a biasing spring resident in the rocker arm.

5. The rocker arm assembly of claim 1 further comprising an actuator structured to rotate the swing lock about the pivot axis from the stopped orientation toward the idled orientation in opposition to the biasing force.

6. The rocker arm assembly of claim 1 wherein the rocker arm includes a pivot pin bore formed in the one of the valve end or the cam end, and further comprising a pivot pin within the pivot pin bore and attached to the holder.

7. An engine valve system comprising:

a cam rotatable about a cam axis;

an engine valve;

a rocker arm including a valve end, a cam end, and a shaft bore formed between the valve end and the cam end;

a rocker shaft positioned in the shaft bore and supporting the rocker arm for reciprocating movement in response to rotation of the cam;

a biaser;

a swing lock defining a pivot axis and including an elongated member having a pivot end and an opposite actuating end, the actuating end including an actuating surface, the elongated member being pivotably mounted on the rocker arm to pivot about the pivot axis with the pivot axis being disposed between the pivot end and the actuating end, the swing lock being rotatable about the pivot axis relative to the rocker arm between a stopped orientation and an idled orientation, and the biaser being operatively coupled to the pivot end of the elongated member to bias the swing lock towards the stopped orientation;

the swing lock is trapped between the rocker arm and one of the engine valve or the cam, at the stopped orientation, such that the actuating surface transmits movement of reciprocation between the rocker arm and the respective one of the engine valve or the cam, and the engine valve is activated; and the swing lock is not trapped between the rocker arm and the respective one of the engine valve or the cam at the idled orientation, such that the actuating surface does not transmit the movement of reciprocation, and the engine valve is deactivated.

8. The engine valve system of claim 7 wherein the swing lock further includes a roller holder defining the pivot axis, and a roller supported in the roller holder for rotation about a roller axis and including the actuating surface.

9. The engine valve system of claim 8 wherein the idled orientation is one of a plurality of idled orientations defining an angular range about the pivot axis, and the swing lock is rotatable about the pivot axis in the angular range.

10. The engine valve system of claim 8 wherein the roller axis defines a pivot path between the stopped orientation and the idled orientation that extends between the rocker arm and the respective one of the engine valve or the cam.

11. The engine valve system of claim 7 wherein the rocker arm further includes a stop contacted by the swing lock at the stopped orientation.

12. The engine valve system of claim 11 further comprising an actuator structured to rotate the swing lock about the pivot axis from the stopped orientation toward the idled orientation, in opposition to a biasing force of the biaser.

13. The engine valve system of claim 12 wherein the actuator includes a fluid actuated pin actuator.

14. The engine valve system of claim 7 wherein the swing lock is attached to the valve end of the rocker arm, and trapped between the rocker arm and the engine valve at the stopped orientation.

15. The engine valve system of claim 7 wherein the swing lock is attached to the cam end of the rocker arm, and trapped between the rocker arm and the cam at the stopped orientation.

16. The engine valve system of claim 7 wherein the elongated member is elongated in a direction generally perpendicular to the cam axis.

17. A method of operating an engine valve system comprising:

reciprocating a rocker arm based on rotation of a cam in the engine valve system;

opening and closing an engine valve in the engine valve system based on the reciprocation of the rocker arm;

rotating an elongated member of a swing lock about a pivot axis from a stopped orientation where an actuating surface of the swing lock is disposed between the rocker arm and one of the engine valve or the cam to transmit movement of reciprocation between the rocker arm and the respective one of the engine valve or the cam, to an idled orientation, wherein the swing lock is trapped between the rocker arm and the respective one of the engine valve or the cam at the stopped orientation, and the rotating of the elongated member of the swing lock includes rotating the swing lock from the stopped orientation against a biasing force of a biaser;

deactivating the engine valve based on the rotating the elongated member of the swing lock about the pivot axis from the stopped orientation to the idled orientation by an application of an actuating force from a fluid actuator applied to a pivot end of the elongated member so that the swing lock is not trapped between the rocker arm and the respective one of the engine valve or the cam, wherein the pivot axis is disposed between the pivot end of the elongated member and a location at which the biasing force is applied to the swing lock; and reciprocating the actuating surface in an angular range about the pivot axis relative to the one of the engine valve or the cam while the engine valve is deactivated.

18. The method of claim 17 further comprising braking an engine based on the deactivating of the engine valve.

19. The method of claim 17 wherein the rotating of the swing lock includes rotating the elongated member based on application of a linear actuating force applied to the swing lock with the fluid actuator.

* * * * *